US005348374A

United States Patent [19]

Kuo

[11] Patent Number: 5,348,374

[45] Date of Patent: Sep. 20, 1994

[54] HIGH CHAIR

[75] Inventor: Tzu-Yu Kuo, Tainan, Taiwan

[73] Assignee: Baby Trend, Inc., Pomona, Calif.

[21] Appl. No.: 960,476

[22] Filed: Oct. 9, 1992

[30] Foreign Application Priority Data

Aug. 6, 1992 [TW] Taiwan ..... 81210919
Sep. 9, 1992 [DE] Fed. Rep. of Germany ... 9212161[U]

[51] Int. Cl.[5] ..... A47D 1/00

[52] U.S. Cl. ..... 297/344.18; 297/151; 297/153; 248/408

[58] Field of Search ..... 297/130, 149, 153, 345, 297/346, 174, 151, 344.18; 248/408, 411, 125, 222.2

[56] References Cited

U.S. PATENT DOCUMENTS

| | | | |
|---|---|---|---|
| 424,730 | 4/1890 | Schoonmaker | 297/345 |
| 1,727,326 | 9/1929 | Burnett | 248/108 |
| 2,245,118 | 6/1941 | Stephens | 248/125 |
| 2,550,352 | 4/1951 | Hodgson et al. | 297/153 |
| 3,194,403 | 7/1965 | Van Horn | 248/222.2 |
| 3,542,419 | 11/1970 | Spinola | 297/130 |
| 4,065,175 | 12/1977 | Perego | 297/345 X |
| 4,344,593 | 8/1982 | Canto | 248/222.2 |
| 4,585,271 | 4/1986 | Wu | 297/174 |
| 5,165,755 | 11/1992 | Rho | 297/345 |

FOREIGN PATENT DOCUMENTS

| | | | |
|---|---|---|---|
| 681131 | 1/1963 | Italy | 297/346 |
| 171264 | 11/1921 | United Kingdom | 297/153 |

*Primary Examiner*—Kenneth J. Dorner
*Assistant Examiner*—David E. Allred
*Attorney, Agent, or Firm*—Donald R. Comuzzi; Christopher L. Makay

[57] ABSTRACT

A high chair utilized primarily for infants or young children comprises a chair section which is mounted onto a frame section. The position of the chair mount on the frame section is adjustable, thereby, making the height of the chair section of the high chair adjustable. The height adjustability of the high chair allows it to accommodate tables, countertops, chairs, and stools of varying height. Furthermore, the chair section is provided with a tray which is positionably adjustable on the chair section as well as completely detachable. The positional adjustment of the tray permits the high chair to snugly and, therefore, safely hold infants and young children of different size. Additional features of the high chair include a mount which allows the chair section to be mounted onto a planar surface, and an auxiliary support which permits the seat section to be rested on a planar surface.

11 Claims, 7 Drawing Sheets

HIGH CHAIR

BACKGROUND OF THE INVENTION

1. Field of the Invention

The present invention relates to high chairs, and more particularly, but not by way of limitation, to high chair used primarily for babies the height of which is adjustable as well as the distance between the tray and the seat.

2. Description of the Prior Art

Many families with infants or young children use high chairs to seat them during feeding and help prevent messes, especially if the child feeds himself or herself. Such high chairs typically include a tray positioned in front of the high chair seat in order to prevent the child from falling out of the high chair, hold the food and drink, and catch any dropped food or spilled drink. The tray is positioned in front of the high chair back such that there is adequate space for the child to be seated. Additionally, to facilitate easier seating of the child, conventional trays are equipped with two arms which are rotatably connected to the back of the high chair at respective ends to permit the lifting of the tray away from the front of the high chair seat (see FIG. 7). That is, once the infant or small child is placed in the seat, the tray is returned to its position in front of the high chair back, thereby, securing the child.

Unfortunately, conventional high chairs suffer several disadvantages. Specifically, they are not height adjustable, and the space between the tray and the back of the chair is fixed. Height adjustability is important because not all chairs or stools positioned about tables and countertops are the same height. An infant in a high chair which is taller or shorter than the chair in which the feeder is sitting will be troublesome to feed. The fixed position between the tray and the back of the high chair creates problems because not all infants or young children are the same size. That is, an infant smaller than the space will not be securely held and might even slide under the tray and fall, possibly injuring himself or herself. Furthermore, an infant or child which has grown larger than the space will not fit at all, requiring the purchase of another high chair.

The present invention, therefore, was originated to solve these and other problems experienced by conventional high chairs.

SUMMARY OF THE INVENTION

It is an object of the present invention to provide a high chair utilized primarily for infants and young children which is adjustable in relation to the height of the seat and to the space between the tray and the back of the seat.

It is another object of the present invention to provide a high chair which may be adjusted to fit different sized infants and young children.

It is a further object of the present invention to provide a high chair which may adjusted to fit different sized tables and countertops.

It is still another object of the present invention to provide a high chair which is easy to operate.

It is still a further object of the present invention to provide a high chair which is rollable.

It is even a further object of the present invention to provide a high chair which is inexpensive to produce.

Still other features and advantages of the present invention will become evident to those skilled in the art in light of the following.

DETAILED DESCRIPTION OF THE PREFERRED EMBODIMENT

Figure 1:
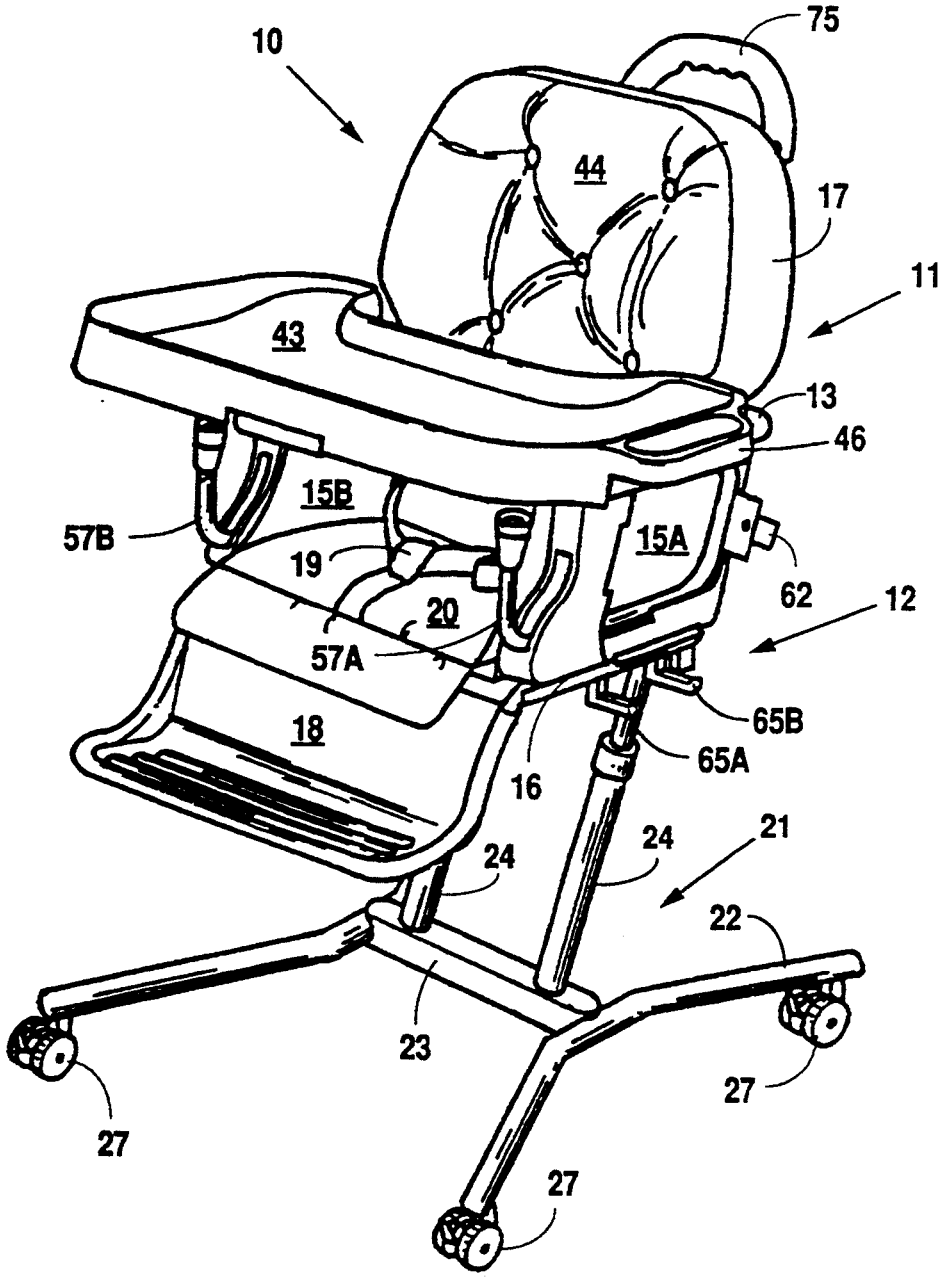
FIG. 1 is a perspective view showing the high chair according to the preferred embodiment of the present invention.
Figure 2:
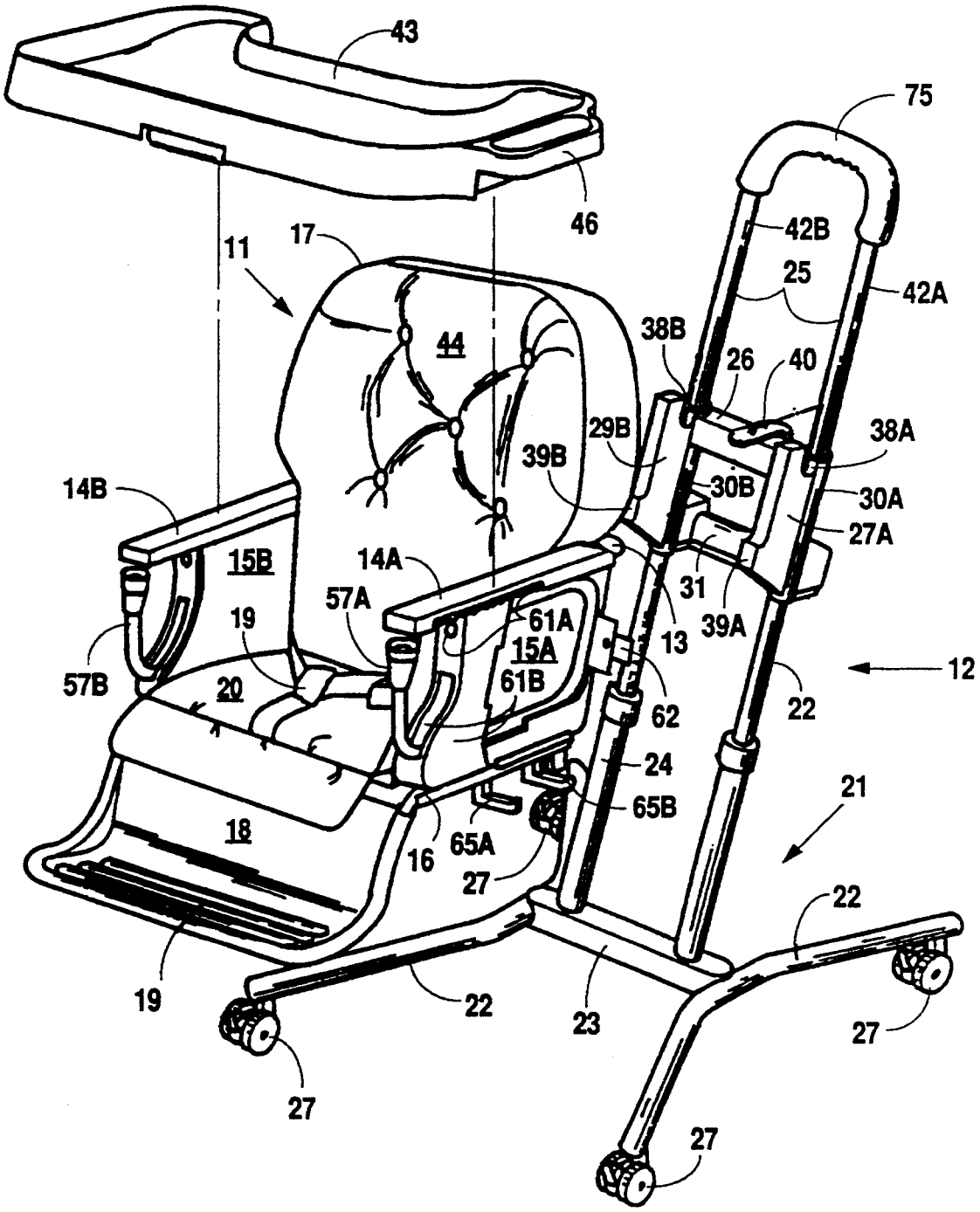
FIG. 2 is an exploded perspective view showing the high chair according to the preferred embodiment of the present invention.

Referring to FIGS. 1 and 2, the overall configuration of the high chair according to the preferred embodiment of the present invention will be described. High chair 10 comprises chair section 11 and frame section 12. Chair section 11 comprises seat support member 13, U-shaped in the preferred embodiment, which serves as the support frame for the seat portion of chair section 11 and further functions to connect and secure chair section 11 onto frame section 12. Arms 14A and B and sides 15A and B are formed integrally and are attached to U-shaped member 13 along arms 14A and B using any suitable fastening means such screws. Seat bottom 16 connects to sides 15A and B using any suitable fastening means such as screws and along with arms 14A and B and sides 15A and B forms the seat portion of chair section 11. Seat cushion 20 is attached to the seat portion to provide a pad which serves to make the seat portion more comfortable. Chair section 11 further comprises chair back 17 formed of a cushion 44 coupled to back support member 45 (see FIGS. 3A and B, 4C, 5A and B, or 6). Chair back 17 mounts in front of seat support member 13 and connects to the rear edges of sides 15A and B using any suitable fastening means such as screws such that there is a space between back support member 45 and seat support member 13. Chair section 11 is also equipped with foot rest 18 which prevents the feet of an infant user from dangling. Foot rest 18 is mounted by slidably and adjustably fitting the support rod about which it is constructed into the enclosed grooves formed at the edges of seat bottom 16. Safety belt 19 is provided to secure an infant user within chair section 11.

Frame section 12 comprises stand 21, support member 25, and chair mount 26. Stand 21 comprises feet 22 connected together by brace 23 which is further connected to support rods 24. Feet 22, brace 23, and support rods 24 are connected together using any suitable connection technique such as welding. Stand 21 further comprises wheels 27 which are connected at the ends of feet 22 to produce easy mobility of high chair 10. However, each of wheels 27 is equipped with a locking mechanism which inhibits their ability to roll and, therefore, prevents unwanted movement of high chair 10. Support member 25 comprises an elongated U-shaped tube, having handle portion 75 and rod portions 42A and B, which removably mount within support rods 24 to produce a support that allows adjustments in the height of chair section 11 (described herein). To prevent unwanted detachment of support member 25 from support rods 24, support member 25 is equipped at the end of rod portion 42B with a resilient tab (not shown) that fits into a slot (not shown) in the corresponding support rod. Support member 25 is further constructed such that rod portions 42A and B each have a plurality of holes (see FIGS. 3A and B) positioned along their back sides which function to form adjustable connections between support member 25 and chair mount 26 (described below).

Figure 3A:
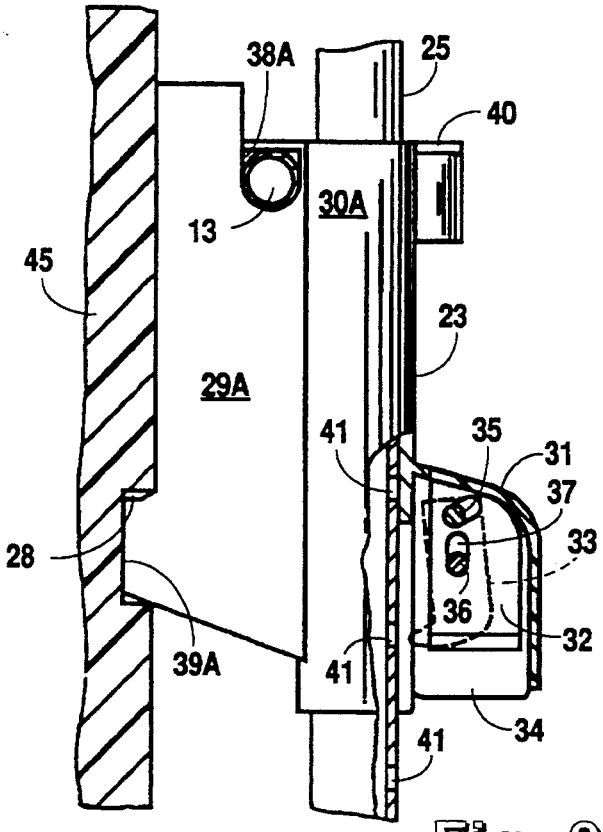
FIGS. 3A and 3B are partially sectioned side views showing the height adjustment apparatus according to the preferred embodiment of the present invention.
Figure 3B:
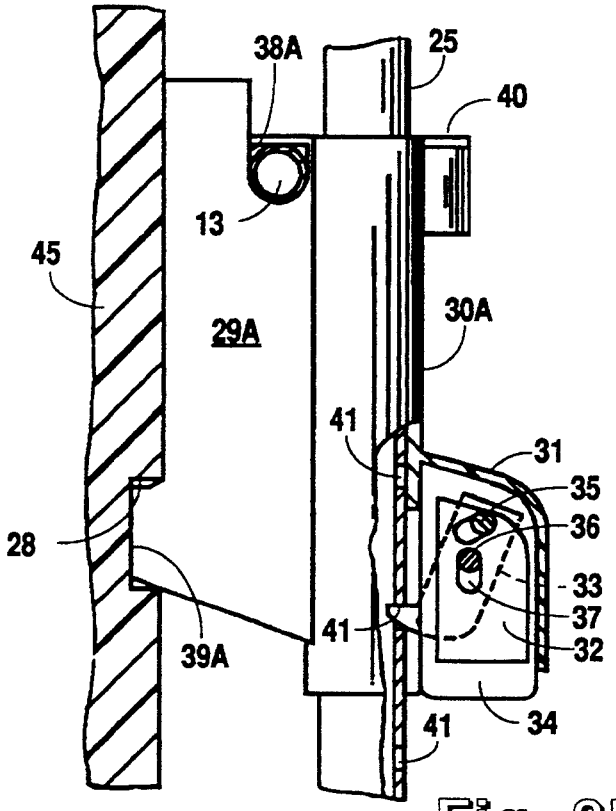
Figure 4A:
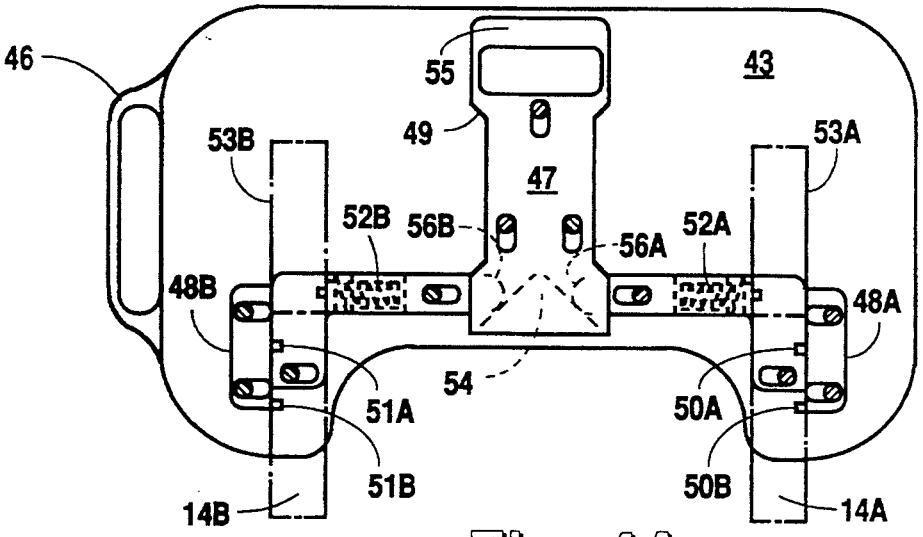
FIGS. 4A and 4B are bottom views showing the tray adjustment apparatus according to the preferred embodiment of the present invention.
Figure 4B:
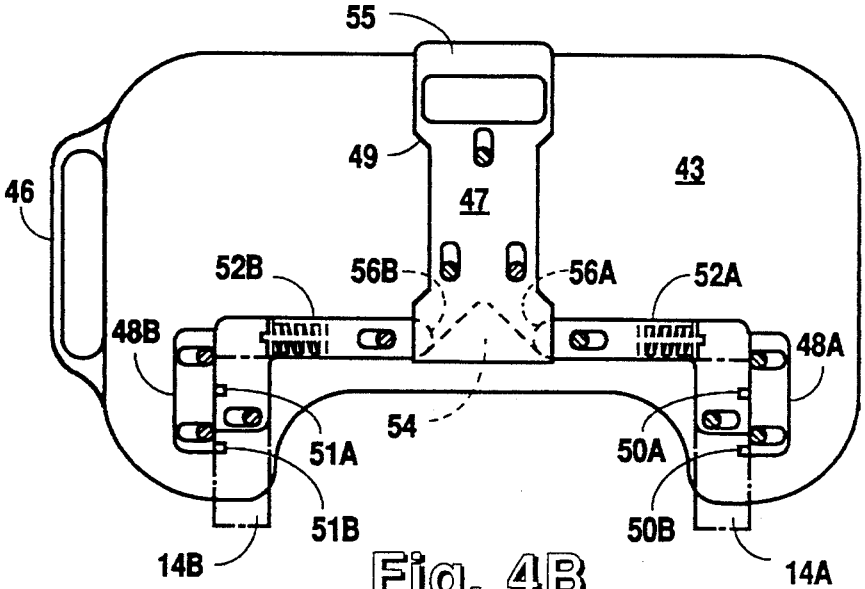
Figure 4C:
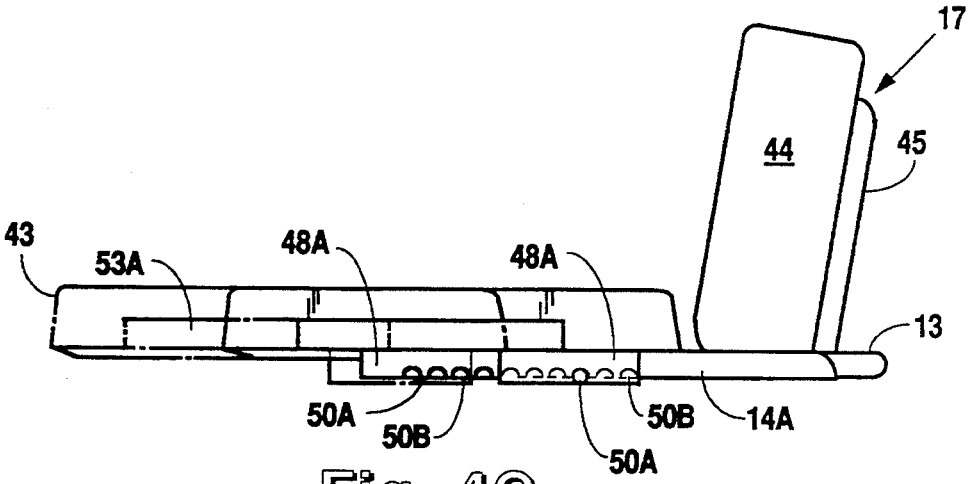
FIG. 4C is a side view showing the tray adjustment apparatus according to the preferred embodiment of the present invention.

Referring to FIGS. 2, 3A, and 3B, chair mount 26 and the mounting of chair section 11 onto frame section 12 via chair mount 26 will be described. Chair mount 26 comprises flange portions 29A and B, a coupling member comprised of tubular portions 30A and B, and locking mechanism chamber 31, all of which are formed integrally into a single housing. Chair mount 26 further comprises latch 40 (described herein). Flange portions 29A and B each have a notch 38A and B, respectively, and a protuberance 39A and B, respectively, which facilitate the connection between chair section 11 and chair mount 26. Tubular portions 30A and B of the coupling member fit about the elongated rod portions of support member 25 to connect chair mount 26 to support member 25 and aid in its slidable motion along support member 25. To secure chair mount 26 to support member 25 and prevent its slidable motion along support member 25, chair mount 26 is supplied with locking mechanism 32 which is housed within locking mechanism chamber 31. Locking mechanism 32 comprises lever 34 which includes hook 33 pivotally connected to one end of lever 34 by pivot pin 35 and a second hook (not shown) pivotally connected to the opposite end of lever 34 by a similar pivot pin. Lever 34 mounted within locking mechanism chamber 31 utilizing pin 36 which extends through a portion of locking mechanism chamber 31, slot 37 of lever 34, and hook 33, and a second pin mounted through the opposite end of lever 34 in a similar manner. Furthermore, mounted between lever 34 and locking mechanism chamber 31 are a pair of springs (not shown) which provide a downward force against lever 34 to facilitate resilient movement of lever 34 within locking mechanism chamber 31. Additionally, in the locked position, lever 34 is forced downward by the springs which forces hook 33 and also the hook connected to the opposite end of lever 34 through a slot (not shown) formed in each tubular portion in order to engage support member 25 as shown in FIG. 3B (described herein).

Chair section 11 mounts onto chair mount 26 utilizing seat support member 13 and a pair of recessed slots 28 (see FIGS. 3A and B) formed back support member 45. To mount chair section 11 onto chair mount 26, seat support member 13 is placed within notches 38A and B, and protuberances 39A and B are fitted within recessed slots 28 in back support member 45 (see FIGS. 3A and B). Latch 40 is then rotated over seat support member 13 in order to prevent the accidental dislodgement of seat support member 13 from notches 38A and B.

Once chair section 11 is attached to frame section 12 via chair mount 26, adjustment of its elevation will be necessary to accommodate tables of varying height. Chair mount 26 is connected to support member 25 prior to the mounting of chair section 11 and is capable of being rigidly affixed to support member 25 by locking mechanism 32. Rigid affixation of chair mount 26 to support member 25 is accomplished by positioning hook 33 within one of holes 41 which is one the plurality of holes formed in rod portion 42A of support member 25 (see FIG. 3B). The hook on the opposite end lever 34 is similarly positioned within a hole in rod portion 42B of support member 25 which is parallel to the one in which hook 33 resides. The hooks attached to lever 34 are locked within their respective holes by the restoring force exerted against lever 34 by the springs situated between locking mechanism chamber 31 and lever 34. For example, the downward force on lever 34 exerted by the springs pushes lever 34 down until the top of slot 37 contacts pin 36 which causes pivot pin 35 to slide upward to the rear of its slot, thereby, forcing hook 33 into hole 41 (see FIG. 3B). To adjust the height of chair mount 26 and, thus, chair section 11, lever 34 is pushed within locking mechanism chamber 31 until the bottom of slot 37 contacts pin 36 which causes pivot pin 35 to slide downward to the front of its slot, thereby, retracting hook 33 from hole 41 (see FIG. 3A). Although only the functioning of hook 33 has been described, it is to be understood that the hook on the opposite end of lever 34 operates similarly and in unison with hook 33. After the hooks have been disengaged from support member 25, chair section 11 is free to be slid to a new height where the hooks will be re-engaged with a new set of holes positioned on support member 25. The present invention, therefore, produces a height adjustable high chair.

Referring to FIGS. 1,2, and 4A–C, the adjustable tray according to the preferred embodiment of the present invention will be described. Tray 43 is adapted to be adjustably mounted onto arms 14 and some of its functions include supporting food and drink on the high chair, preventing dropped food or spilled drink from reaching the floor, and restraining the infant within the high chair. Tray 43 includes handle 46 which simplifies the carrying of tray 43 and allows easier storage of tray 43 when not in use (described herein). Arms 14A and B support tray 43 on chair section 11 and further are provided with a series of grooves positioned along their outer edges (see FIGS. 2 and 4C) which hold tray 43 and permit its adjustment. The underside of tray 43 is provided with locking member 47 which facilitates the mounting of tray 43 onto arms 14A and B (see FIGS. 4A and B). Locking member 47 comprises connection arms 48A and B and lever 49 all three of which are mounted underneath tray 43 using any suitable fastening means which permits slidable motion. In the preferred embodiment, connection arms 48A and B and lever 49 are connected to tray 43 by screws placed within elongated slots formed in all three members. Connection between connection arm 48A and arm 14A of chair section 11 is effected by protuberances 50A and B each of which fits into one of the grooves formed on arm 14A (see FIG. 4C). Similarly, connection between connection arm 48B and arm 14B of chair section 11 is effected by protuberances 51A and B each of which fits into one of the grooves formed on arm 14B. The ends of connection arms 48A and B and, thus, protuberances 50A and B and 51 A and B are held securely against arms 14A and B by the restoring force in springs 52A and B. Furthermore, arms 14A and B are adapted to fit within rails 53A and B to further secure tray 43 to chair section 11 (see FIG. 4A). Locking member 47 is equipped with lever 49 so that connection arms 48A and B may be easily manipulated. Connection arms 48A and B are linked to lever 49 through triangularly-shaped block 54. In the locked position when connection arms 48A and B are mounted about arms 14A and B, their ends 56A and B are pulled within lever 49 by springs 52A and B until they rest against the upper portion of triangularly-shaped block 54 (see FIG. 4A). However, to originally mount tray 43 or adjust its position along arms 14A and B, handle 55 of lever 49 is pulled and as the restoring forces of springs 52A and B are overcome, the lower portion of triangularly-shaped block is forced between ends 56A and B of connection arm 48A and B (see FIG. 4B). Forcing the lower portion of triangularly-shaped block between ends 56A and B of connection arm 48A and B, causes protuberances 50A and B and 51A and B to disengage from the groove in which they are residing, thereby, permitting tray 43 to be slid along arms 14A and B. When the desired tray position is reached, handle 55 is released allowing springs 52A and B to return connection arms 48A and B to their locked position, thus, permitting protuberances 50A and B and 51A and B to re-engage a new set of grooves (see FIG. 4C). The present invention, therefore, produces a high chair with a tray having adjustable positions.

Referring to FIGS. 1, 2, 5A, and 5B, the mounting of chair section 11 onto a planar surface such as a table will be described. Although chair section 11 is typically used in conjunction with frame section 12, it is not limited to such a specific use. Chair section 11 is mounted onto a planar surface utilizing mounting members 57A and B (see FIGS. 1 and 2). For ease of disclosure, mounting member 57A and side 15A will be described, however, it is to be understood that mounting member 57B and side 15B are identical. Mounting member 57A comprises U-shaped portion 58 (see FIG. 5A) which terminates at one end in straight arm 59 and at the opposite end in angled arm 60. When not in use, mounting member 57A is housed within side 15A which is furnished with partially enclosed grooves 61A and 61B into which mounting member 57A fits (see specifically FIG. 2). Mounting member 57A is secured within side 15A by spring-loaded latch 62 which is fastened to U-shaped portion 58 of mounting member 57A using any suitable fastening means such as screws. When mounting member 57A is fully retracted within side 15A spring-loaded latch 62 extends beyond the edge of side 15A and engages the back end of side 15A to prevent mounting member 57A from moving (see FIG. 5A). Spring-loaded latch 62 further serves to rigidly secure mounting member 57A to side 15A when mounting member 57A is fully extended. Side 15A is provided with slot 63 which receives spring-loaded latch 62 in order to lock mounting member 57A in its fully extended position and prevent accidental retraction (see FIG. 5A). To mount chair section 11 onto planar surface 64, chair section 11 is held near planar surface 64 while mounting members 57A and B are extended (see FIG. 5B). Angled arm 60 is slid underneath planar section 64 while straight arm 59 is slid over the top. When mounting members 57A and B are fully extended, they are locked in place using their respective spring-loaded latches. Angled arm 60 and straight arm 59 grasp planar surface 64, thereby securing chair section 11 to planar surface 64.

Figure 5A:
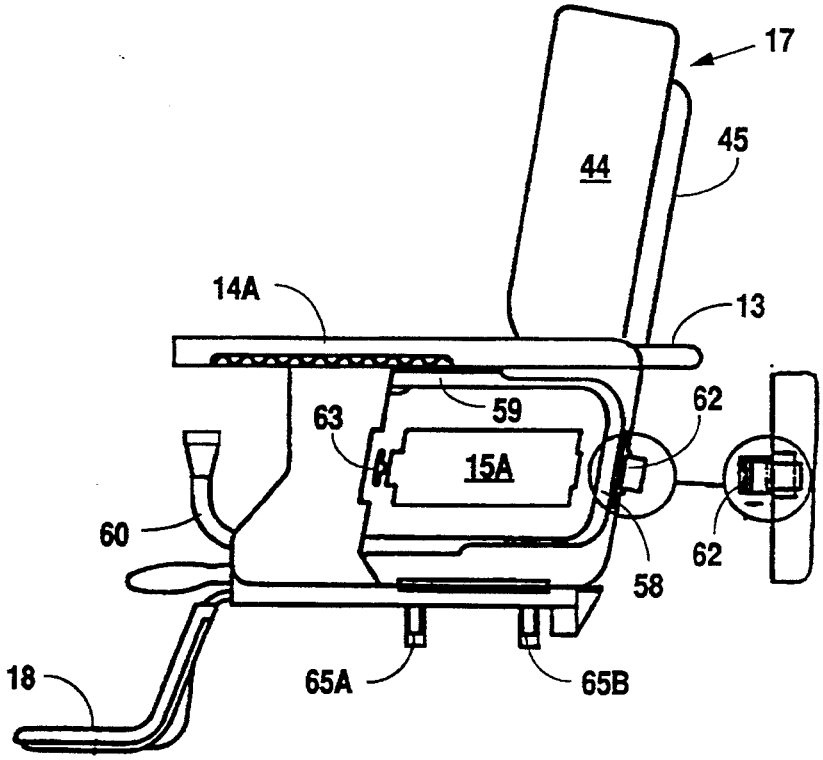
FIG. 5A is side view showing the retracted position of the mounting apparatus used to mount the seat section of the high chair of the present invention onto a planar surface.
Figure 5B:
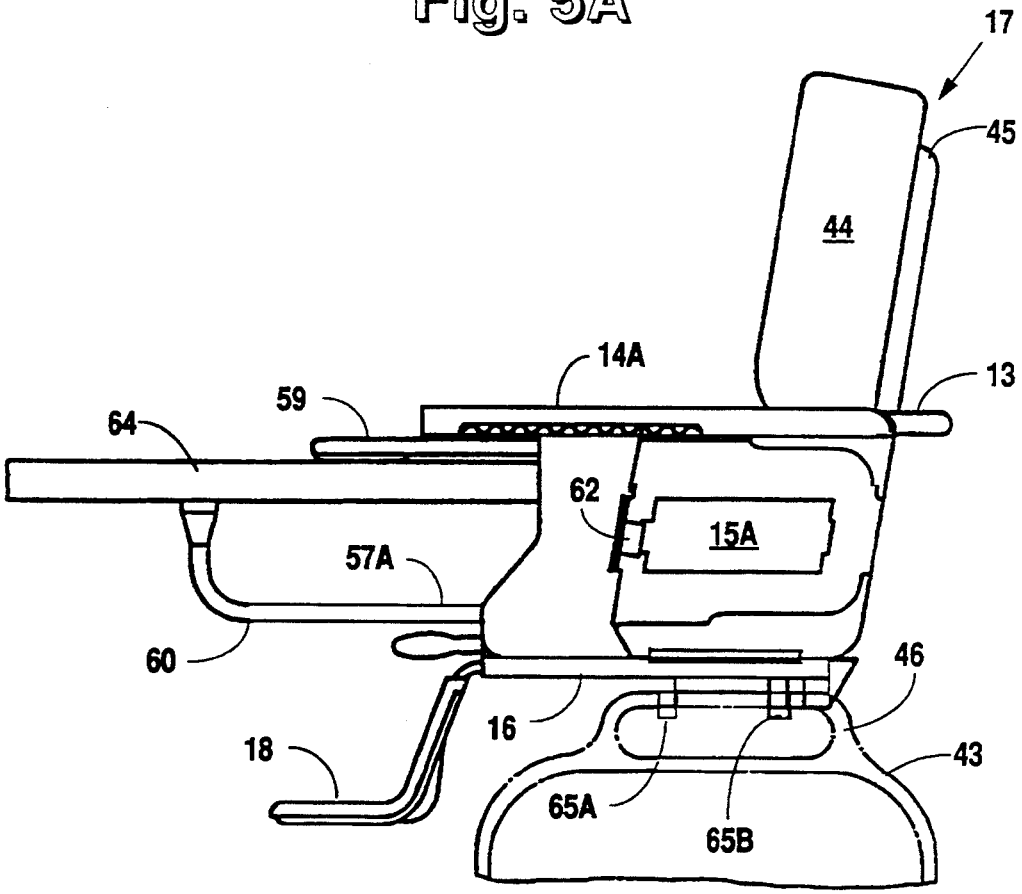
FIG. 5B is side view showing the mounting of the seat section of the high chair of the present invention onto a planar surface using the mounting apparatus.

A further feature of the present invention shown in FIG. 5B are hooks 65A and B. Because chair section 11 has been mounted to planar surface 64, tray 43 is not needed. Therefore, hooks 65A and B have been formed as part of seat bottom 16 in order to allow tray 43 to be hung out of the way on hooks 65*a* and B by handle 46. Hooks 65A and B may be employed at any time when tray storage is desired, and their use is not limited to when chair section 11 is mounted on a planar surface.

Figure 6:
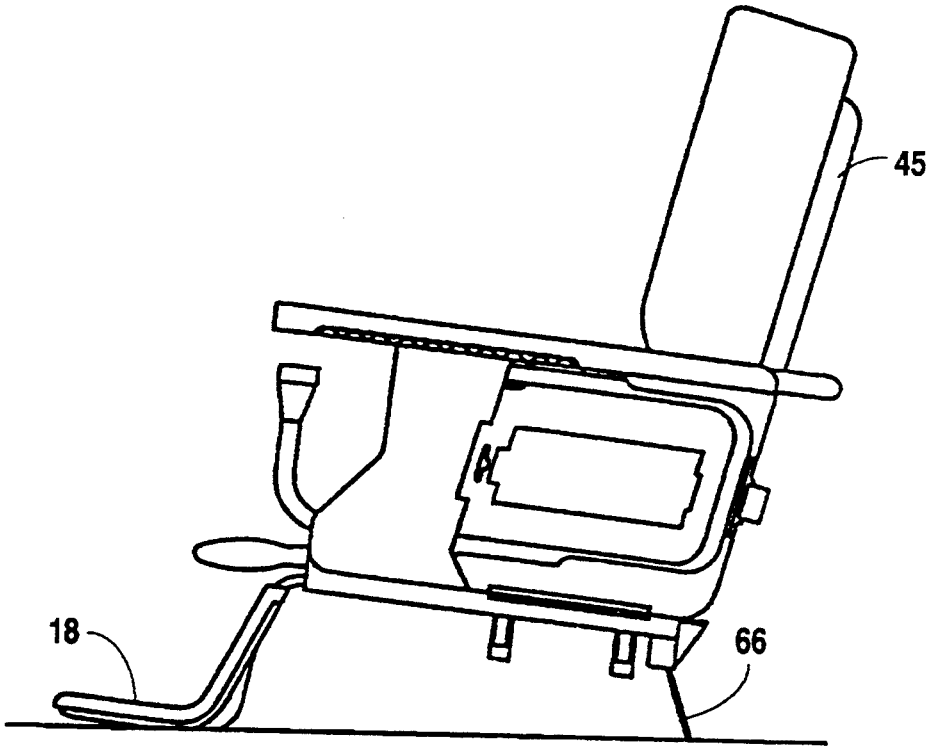
FIG. 6 is a side view showing the support apparatus used to support the seat section of the high chair of the present invention on a planar surface.
Figure 7:
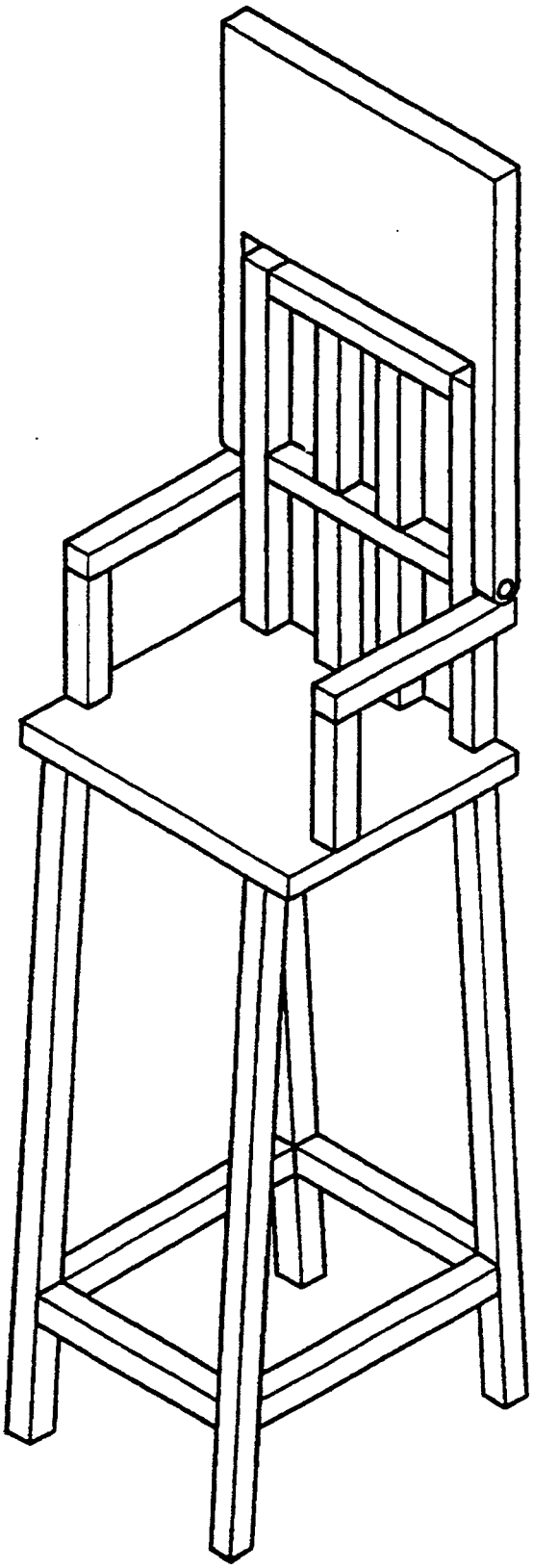
Fig. 7 (PRIOR ART)
FIG. 7 is a perspective view of a high chair according to the prior art.

Referring to FIG. 6, the positioning of chair section 11 on a planar surface will be described. Chair section 11 is provided with auxiliary support 66 which is pivotally connected to seat bottom 16. Auxiliary support 66 operates in conjunction with foot rest 18 to permit chair section 11 to be firmly planted on a planar surface without fear of chair section 11 being easily overturned.

From the foregoing description and illustration of this invention, it is apparent that various modifications can be made by reconfigurations or combinations to produce similar results. It is, therefore, the desire of Applicant not to be bound by the description of the invention contained in this specification, but to be bound only by the claims as appended hereto.

I claim:

1. A high chair comprising:

a frame means;

chair means;

tray means mounted on said chair means; and means for mounting said chair means on said frame means wherein said means for mounting is adjustably positionable along said frame means to provide height adjustment of said chair means, said means for mounting, comprising:

a coupling member mounted about said frame means for facilitating slidable motion of said means for mounting, a flange member formed integrally with said coupling member wherein said flange member is provided with notch means for receiving said chair means and protuberances for engaging said chair means, locking means connected to said coupling member for preventing the slidable motion of said means for mounting wherein said locking means is capable of engaging said frame means at a plurality of points.

2. The high chair according to claim 1 wherein said frame means comprises a support member coupled to a stand.

3. The high chair according to claim 2 wherein said stand of said frame means is provided with wheels wherein said wheels are lockable to prevent their rolling.

4. The high chair according to claim 1 wherein said chair means comprises:

a support member;

a seat section affixed to said support member; and a chair back affixed to said seat section.

5. The high chair according to claim 4 wherein said chair means further comprises a foot rest means coupled to said seat section.

6. The high chair according to claim 4 wherein said chair means further comprises mounting means to facilitate the mounting of said chair means adjacent to a planar surface.

7. The high chair according to claim 4 wherein said chair means further comprises auxiliary support means to facilitate the positioning of said chair means on a planar surface.

8. The high chair according to claim 4 wherein said chair means further comprises hook means coupled to said seat section to provide a storage means for said tray means when said tray means is not mounted on said seat section.

9. The high chair according to claim 1 wherein said tray means comprises:

a tray;

resilient arms affixed to said tray for engaging said seat section of said chair means wherein said resilient arms are capable of engaging said seat section at a plurality of points to facilitate the adjustment of the position of said tray on said seat section;

lever means coupled to said resilient arms for manipulating the engaging and disengaging of said resilient arms to said seat section.

10. The high chair according to claim 1 wherein said means for mounting further comprises a latch means affixed to said coupling member for latching said chair means within said notch means of said flange member.

11. The high chair according to claim 1 wherein said tray means is positionably adjustable on said chair means and further wherein said tray means is detachable from said chair means.

* * * * *